US010400318B2

(12) United States Patent
Nakamura et al.

(10) Patent No.: US 10,400,318 B2
(45) Date of Patent: Sep. 3, 2019

(54) FERRITIC STAINLESS STEEL

(71) Applicant: JFE STEEL CORPORATION, Chiyoda-Ku, Tokyo (JP)

(72) Inventors: Tetsuyuki Nakamura, Chiba (JP); Hiroki Ota, Handa (JP); Chikara Kami, Kurashiki (JP)

(73) Assignee: JFE STEEL CORPORATION, Tokyo (JP)

( * ) Notice: Subject to any disclaimer, the term of this patent is extended or adjusted under 35 U.S.C. 154(b) by 395 days.

(21) Appl. No.: 15/311,023

(22) PCT Filed: May 12, 2015

(86) PCT No.: PCT/JP2015/002407

§ 371 (c)(1),
(2) Date: Nov. 14, 2016

(87) PCT Pub. No.: WO2015/174079

PCT Pub. Date: Nov. 19, 2015

(65) Prior Publication Data

US 2017/0073800 A1 Mar. 16, 2017

(30) Foreign Application Priority Data

May 14, 2014 (JP) ..... 2014-100346

(51) Int. Cl.

| | |
|---|---|
| ***C22C 38/54*** | (2006.01) |
| ***C22C 38/02*** | (2006.01) |
| ***C22C 38/04*** | (2006.01) |
| ***C22C 38/06*** | (2006.01) |
| ***C22C 38/20*** | (2006.01) |
| ***C22C 38/26*** | (2006.01) |
| ***C22C 38/28*** | (2006.01) |
| ***C22C 38/42*** | (2006.01) |
| ***C22C 38/44*** | (2006.01) |
| ***C22C 38/46*** | (2006.01) |
| ***C22C 38/48*** | (2006.01) |
| ***C22C 38/50*** | (2006.01) |
| ***C22C 38/52*** | (2006.01) |
| ***C21D 9/46*** | (2006.01) |
| ***C22C 38/00*** | (2006.01) |

(52) U.S. Cl.

CPC ..... *C22C 38/54* (2013.01); *C22C 38/00* (2013.01); *C22C 38/001* (2013.01); *C22C 38/002* (2013.01); *C22C 38/004* (2013.01); *C22C 38/005* (2013.01); *C22C 38/02* (2013.01); *C22C 38/04* (2013.01); *C22C 38/06* (2013.01); *C22C 38/20* (2013.01); *C22C 38/26* (2013.01); *C22C 38/28* (2013.01); *C22C 38/42* (2013.01); *C22C 38/44* (2013.01); *C22C 38/46* (2013.01); *C22C 38/48* (2013.01); *C22C 38/50* (2013.01); *C22C 38/52* (2013.01); *C21D 9/46* (2013.01)

(58) Field of Classification Search
None
See application file for complete search history.

(56) References Cited

U.S. PATENT DOCUMENTS

| | | | | |
|---|---|---|---|---|
| 8,153,055 | B2 * | 4/2012 | Nakamura | C22C 38/06 420/60 |
| 9,157,137 | B2 * | 10/2015 | Nakamura | C22C 38/06 |
| 9,279,172 | B2 * | 3/2016 | Kato | C22C 38/06 |
| 9,809,869 | B2 * | 11/2017 | Nakagawa | C22C 38/54 |
| 2006/0163231 | A1 | 7/2006 | Kobayashi et al. | |
| 2008/0138233 | A1 * | 6/2008 | Tomita | C21D 9/46 420/61 |
| 2011/0123387 | A1 | 5/2011 | Kato et al. | |
| 2012/0020827 | A1 | 1/2012 | Nakamura et al. | |
| 2013/0183190 | A1 | 7/2013 | Nakamura et al. | |
| 2013/0272912 | A1 * | 10/2013 | Nakamura | C22C 38/06 420/36 |
| 2013/0306204 | A1 | 11/2013 | Teraoka et al. | |
| 2016/0281189 | A1 * | 9/2016 | Fujisawa | C22C 38/00 |
| 2017/0175217 | A1 * | 6/2017 | Nakamura | C22C 38/54 |

FOREIGN PATENT DOCUMENTS

| | | | |
|---|---|---|---|
| CN | 101454471 | A | 6/2009 |
| EP | 1930461 | A1 | 6/2008 |
| EP | 2 058 413 | A1 | 5/2009 |
| EP | 2 639 325 | A1 | 9/2013 |
| EP | 2767605 | A1 | 8/2014 |
| JP | H08-109443 | A | 4/1996 |
| JP | 2000169943 | A | 6/2000 |
| JP | 2000-297355 | A | 10/2000 |
| JP | 2001-185413 | A | 7/2001 |
| JP | 2001288543 | A | 10/2001 |
| JP | 2001288544 | A | 10/2001 |
| JP | 2001-316773 | A | 11/2001 |
| JP | 2004-018921 | A | 1/2004 |
| JP | 2005-187857 | A | 7/2005 |
| JP | 2006-009056 | A | 1/2006 |
| JP | 2006-117985 | A | 5/2006 |
| JP | 2008-144199 | A | 6/2008 |
| JP | 2008-285693 | A | 11/2008 |

(Continued)

OTHER PUBLICATIONS

English translation of the Written Opinion of the International Search Authority dated Jul. 28, 2015 for PCT/JP2015/002407; 5 pages.*

(Continued)

*Primary Examiner* — Helene Klemanski
(74) *Attorney, Agent, or Firm* — Oliff PLC

(57) ABSTRACT

A ferritic stainless steel that a composition including in terms of % by mass, C: 0.015% or less, Si: 1.0% or less, Mn: 1.0% or less, P: 0.040% or less, S: 0.010% or less, Cr: 10.0% to 23.0%, Al: 0.2% to 1.0%, N: 0.015% or less, Cu: 1.0% to 2.0%, Nb: 0.30% to 0.65%, Ti: 0.50% or less, O: 0.0030% or less, and the balance being Fe and unavoidable impurities, wherein a Si content and an Al content satisfy Si≥Al, and the Al content and an O content satisfy Al/O≥100.

8 Claims, 2 Drawing Sheets

(56) References Cited

FOREIGN PATENT DOCUMENTS

| | | | |
|---|---|---|---|
| JP | 2011-140709 | A | 7/2011 |
| JP | 2012-193435 | A | 10/2012 |
| JP | 2013-100595 | A | 5/2013 |
| JP | 55-05575 | B1 | 5/2014 |
| WO | 03/004714 | A1 | 1/2003 |
| WO | 2009/110641 | A1 | 9/2009 |
| WO | 2011/024568 | A1 | 3/2011 |
| WO | 2012/050226 | A1 | 4/2012 |
| WO | 2012/108479 | A1 | 8/2012 |
| WO | 2014001644 | A1 | 1/2014 |
| WO | WO 2014/147655 | A1 * | 9/2014 |

OTHER PUBLICATIONS

English translation of WO 2014/147655, Sep. 2014; 20 pages.*
Apr. 5, 2017 Search Report issued in European Patent Application No. 15792623.9.
Jul. 28, 2015 International Search Report issued in PCT/JP2015/002407.
Aug. 28, 2017 Office Action issued in Chinese Patent Application No. 201580025042.3.
Jun. 28, 2018 Notice of Allowance issued in Korean Patent Application No. 10-2016-7031445.
May 29, 2018 Office Action issued in European Application No. 15 792 623.9.
Jun. 5, 2018 Office Action issued in Chinese Patent Application No. 201580025042.3.
Jan. 7, 2019 Office Action issued in Chinese Patent Application No. 201580025042.3.

* cited by examiner

FERRITIC STAINLESS STEEL

TECHNICAL FIELD

The present disclosure relates to a ferritic stainless steel that has an excellent thermal fatigue resistance, excellent oxidation resistance, and an excellent high-temperature fatigue resistance. The ferritic stainless steel according to the present disclosure is especially suitable for use in exhaust parts in high-temperature environments, such as exhaust pipes and converter cases of automobiles and motorcycles and exhaust ducts of thermal power plants.

BACKGROUND ART

Exhaust parts such as exhaust manifolds, exhaust pipes, converter cases, and mufflers of automobiles are required to have excellent oxidation resistance, an excellent thermal fatigue resistance, and an excellent high-temperature fatigue resistance (hereinafter these properties are generally referred to as "heat resistance"). Specifically, the meaning of thermal fatigue and high-temperature fatigue is as follows. In the description below concerning the composition, "%" means "% by mass".

Exhaust parts are under restraint with respect to surrounding parts when they are repeatedly heated and cooled as the engine is started and stopped. Thus, thermal expansion and contraction of the exhaust parts are limited and thermal strain is generated in the material of these parts. The fatigue phenomenon attributable to this thermal strain is called thermal fatigue.

High-temperature fatigue is a phenomenon in which parts subjected to continuous vibration while being heated by exhaust gas from engines reach fracture, such as cracking.

Currently, as the material for parts required to have such a heat resistance, Cr-containing steels such as Type 429 steels containing Nb and Si (15% Cr-0.9% Si-0.4% Nb: for example, JFE 429EX) are widely used. However, with improvements in engine performance, exhaust gas reaches a temperature higher than 900° C. At such a temperature, the Type 429 steels may satisfy the required properties but may not sufficiently satisfy a required thermal fatigue resistance in particular.

Examples of the raw material developed to address this issue include SUS 444 steels (for example, 19% Cr—Nb-2% Mo) prescribed in JIS G4305 in which Mo as well as Nb is added to improve high-temperature resistance and ferritic stainless steels containing Nb, Mo, and W (for example, refer to Patent Literature 1). Due to recent extraordinary escalation and fluctuation in price of rare metals such as Mo and W, development of materials that have a comparable heat resistance but use inexpensive raw materials has become desirable.

An example of a material that has an excellent heat resistance but does not contain expensive Mo or W is a ferritic stainless steel for use in automobile exhaust gas flow channels disclosed in Patent Literature 2. This ferritic stainless steel is obtained by adding Nb: 0.50% or less, Cu: 0.8% to 2.0%, and V: 0.03% to 0.20% to a Cr-containing steel having a Cr content of 10% to 20%. Patent Literature 3 discloses a ferritic stainless steel that has an excellent thermal fatigue resistance obtained by adding Ti: 0.05% to 0.30%, Nb: 0.10% to 0.60%, Cu: 0.8% to 2.0%, and B: 0.0005% to 0.02% to a Cr-containing steel having a Cr content of 10% to 20%. Patent Literature 4 discloses a ferritic stainless steel for use in automobile exhaust parts, obtained by adding Cu: 1% to 3% to a Cr-containing steel having a Cr content of 15% to 25%. The feature of these steels is that the thermal fatigue resistance is improved by adding Cu.

Another proposed approach for improving the heat resistance property is to intentionally add Al. For example, Patent Literature 5 discloses a ferritic stainless steel whose thermal fatigue resistance is enhanced by addition of Al: 0.2% to 2.5%, Nb: more than 0.5% to 1.0%, and Ti: 3×(C+N) % to 0.25%. Patent Literature 6 discloses a ferritic stainless steel whose oxidation resistance is improved by forming an $Al_2O_3$ film on a steel surface by addition of Al to a Cr-containing steel that contains Cr: 10% to 25%, and Ti: 3×(C+N) to 20×(C+N). Patent Literature 7 discloses a ferritic stainless steel whose post-hydroforming cracking resistance is improved by fixing C and N by addition of Ti, Nb, V, and Al to a Cr-containing steel having a Cr content of 6% to 25%. Patent Literature 8 discloses a steel having an excellent thermal fatigue resistance, excellent oxidation resistance, and an excellent high-temperature fatigue resistance obtained by adding Nb: 0.3% to 0.65%, Cu: 1.0% to 2.5%, and Al: 0.2% to 1.0% to a Cr-containing steel having a Cr content of 16% to 23%.

CITATION LIST

Patent Literature

PTL 1: Japanese Unexamined Patent Application Publication No. 2004-018921

PTL 2: International Publication No. WO03/004714

PTL 3: Japanese Unexamined Patent Application Publication No. 2006-117985

PTL 4: Japanese Unexamined Patent Application Publication No. 2000-297355

PTL 5: Japanese Unexamined Patent Application Publication No. 2008-285693

PTL 6: Japanese Unexamined Patent Application Publication No. 2001-316773

PTL 7: Japanese Unexamined Patent Application Publication No. 2005-187857

PTL 8: Japanese Unexamined Patent Application Publication No. 2011-140709

SUMMARY

Technical Problem

According to the studies conducted by the inventors, adding Cu to improve the heat resistance, as in steels disclosed in Patent Literatures 2 to 4, will improve a thermal fatigue resistance but deteriorate the oxidation resistance of the steel. As a result, in a comprehensive perspective, the heat resistance is deteriorated.

The steels disclosed in Patent Literatures 5 and 6 have high high-temperature strength and excellent oxidation resistance due to addition of Al. However, these effects are not sufficiently obtained by merely adding Al. For example, according to a steel having a low Si content disclosed in Patent Literature 5, Al is added but Al preferentially forms oxides or nitrides. As a result, the amount of the dissolved Al is decreased, and the expected high-temperature strength is not obtained. According to a steel having a high Al content exceeding 1.0% described in Patent Literature 6, not only the workability at room temperature is significantly deteriorated but also the oxidation resistance is deteriorated since Al is prone to combine with oxygen (O). Moreover, as with the steel disclosed in Patent Literature 7, Cu and Al are optional elements and thus if the Cu content or the Al content is small or not adequate, an excellent heat resistance is not obtained. As described in Patent Literature 8, a steel containing Cu and Al has an excellent heat resistance; it would be more preferable if its high-temperature fatigue resistance can be improved.

An object of the present disclosure is to provide a ferritic stainless steel that contains Cu and Al and has a particularly excellent high-temperature fatigue resistance and an excellent heat resistance. For the purposes of the present disclosure, a "particularly excellent high-temperature fatigue resistance" means that fracture does not occur even when 75 MPa plane bending stress is applied $100\times10^5$ times at 850° C. For the purposes of the present disclosure, an "excellent thermal fatigue resistance" means that when cycles are repeated between 100° C. and 850° C. at a restrain ratio of 0.35, the thermal fatigue lifetime is 1120 cycles or more. For the purposes of the present disclosure, "excellent oxidation resistance" means that the weight gain by oxidation is 27 $g/m^2$ or less when the steel is held in air at 950° C. for 300 hours.

Solution to Problem

The inventors have conducted extensive studies on the effects of various additive elements on the high-temperature fatigue resistance of a steel containing Nb, Cu, and Al and found that the oxygen (O) content in the steel affects the high-temperature fatigue resistance. The exemplary disclosed embodiments include:

[1] A ferritic stainless steel having a composition comprising, in terms of % by mass, C: 0.015% or less, Si: 1.0% or less, Mn: 1.0% or less, P: 0.040% or less, S: 0.010% or less, Cr: 10.0% to 23.0%, Al: 0.2% to 1.0%, N: 0.015% or less, Cu: 1.0% to 2.0%, Nb: 0.30% to 0.65%, Ti: 0.50% or less, O: 0.0030% or less, and the balance being Fe and unavoidable impurities, wherein a Si content and an Al content satisfy Si≥Al, and the Al content and an O content satisfy Al/O≥100.

[2] The ferritic stainless steel according to [1], wherein the composition further comprises at least one element selected from the group consisting of B: 0.0030% or less, REM: 0.080% or less, Zr: 0.50% or less, V: 0.50% or less, Co: 0.50% or less, and Ni: 0.50% or less.

[3] The ferritic stainless steel according to [1] or [2], wherein the composition further comprises at least one element selected from the group consisting of Ca: 0.0050% or less and Mg: 0.0050% or less.

[4] The ferritic stainless steel according to any one of [1] to [3], wherein the composition further comprises Mo: 0.1% to 1.0% or less.

Advantageous Effects

According to the present disclosure, a ferritic stainless steel having a high-temperature fatigue resistance superior to that of SUS 444 can be provided at a lower cost. Thus, the steel of the present disclosure is particularly suitable for use in exhaust parts of automobiles and the like.

DESCRIPTION OF EMBODIMENTS

Figure 1:
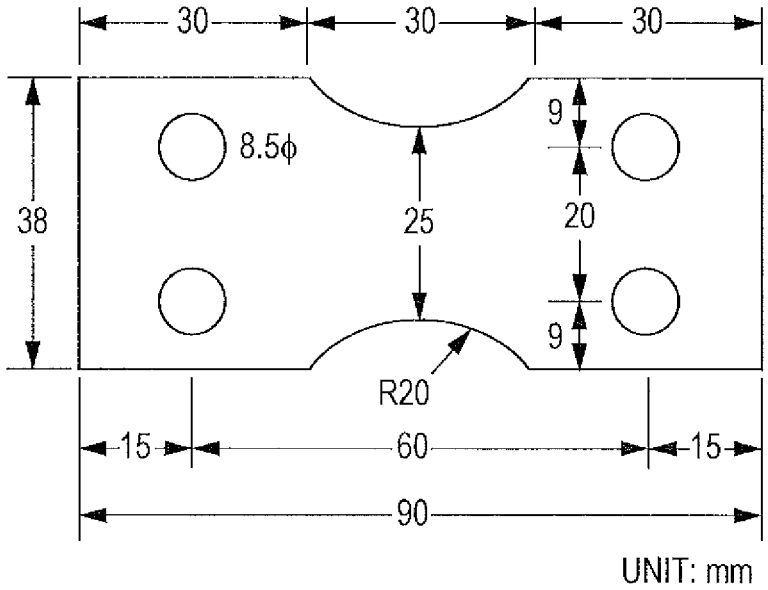
FIG. 1 A diagram illustrating a high-temperature fatigue test specimen.

The exemplary disclosed embodiments now be described. The embodiments described below do not limit the scope of the present disclosure.

A composition of the ferritic stainless steel according to the present disclosure is described. In the description below, "%" indicating the content of the component means "% by mass".

C: 0.015% or Less

Carbon (C) is an element effective for increasing the strength of steel. At a C content exceeding 0.015%, however, the toughness and formability are significantly deteriorated. Thus, in the present disclosure, the C content is to be 0.015% or less. The C content is preferably 0.010% or less in order to reliably obtain formability. From the viewpoint of obtaining the strength appropriate for the exhaust parts, the C content is preferably 0.001% or more and more preferably in the range of 0.003% to 0.008%.

Si: 1.0% or Less

Silicon (Si) is an element that improves oxidation resistance. In order to obtain this effect, the Si content is preferably 0.02% or more. If the Si content exceeds 1.0%, the steel becomes hard and the workability is deteriorated. Thus, in the present disclosure, the Si content is to be 1.0% or less and preferably 0.20% or more and 1.0% or less.

Silicon (Si) is also an element that contributes to improving oxidation resistance in a water-vapor-containing atmosphere such as automobile exhaust gas. If the oxidation resistance needs to be improved, the Si content is preferably 0.40% or more and more preferably in the range of 0.50% to 0.90%.

Si≥Al

Silicon (Si) is also an important element for effectively utilizing the solid solution strengthening ability of Al described below. Aluminum (Al) is an element that has a solid solution strengthening effect even at high temperature and has an effect of increasing the strength through out the entire temperature range from room temperature to high temperature. However, if the Al content is higher than the Si content, the Al preferentially forms oxides and nitrides at high temperature and the amount of dissolved Al is decreased. Then Al can no longer sufficiently contribute to solid solution strengthening. On the other hand, if the Si content is equal to or higher than the Al content, Si is preferentially oxidized and a dense oxide layer is continuously formed on a steel sheet surface. This oxide layer has an effect of suppressing inward diffusion of oxygen and nitrogen from outside and thus oxidation and nitriding of Al can be minimized. As a result, the solid solution state of Al can be stabilized and the high-temperature strength can be improved. Thus, in the present disclosure, the Si content and the Al content are adjusted so that the relationship Si≥Al is satisfied. More preferably, the Si content and the Al content are controlled so that Si≥1.4×Al is satisfied. In this inequality, Si and Al respectively represent the silicon content and the aluminum content (in terms of % by mass).

Mn: 1.0% or Less

Manganese (Mn) is an element which is added for deoxidation and to increase the strength of the steel. Manganese also has an effect of suppressing spalling of oxide scale. In order to obtain these effects, the Mn content is preferably 0.02% or more. At an excessively large Mn content, however, γ phases are easily generated at high temperature and the heat resistance is deteriorated. Thus, the Mn content is to be 1.0% or less. The Mn content is preferably 0.05% to 0.80% and more preferably 0.10% to 0.50%.

P: 0.040% or Less

Phosphorus (P) is a harmful element that deteriorates toughness of the steel and thus the P content is preferably as low as possible. In the present disclosure, the P content is to be 0.040% or less and preferably 0.030% or less.

S: 0.010% or Less

Sulfur (S) deteriorates formability by decreasing elongation or r value. Sulfur is also a harmful element that deteriorates corrosion resistance, which is the basic property of stainless steel. Thus, the S content is desirably as low as possible. In the present disclosure, the S content is to be 0.010% or less and preferably 0.005% or less.

Cr: 10.0% to 23.0%

Chromium (Cr) is an important element effective for improving corrosion resistance and oxidation resistance, which are the features of stainless steel. At a Cr content less than 10.0%, sufficient oxidation resistance is not obtained. On the other hand, Cr is an element that causes solid solution strengthening of the steel at room temperature, hardens the steel, and deteriorates the ductility of the steel. In particular, at a Cr content exceeding 23.0%, these adverse effects become notable. Thus, the Cr content is to be in the range of 10.0% to 23.0%, preferably in the range of 12.0% to 20.0%, and more preferably in the range of 14.0% to 18.0%.

Al: 0.2% to 1.0%

Aluminum (Al) is an essential element for improving oxidation resistance of the Cu-containing steel. In particular, in order for a Cu-containing steel to obtain oxidation resistance comparable or superior to that of SUS 444, the Al content must be 0.2% or more. On the other hand, if the Al content exceeds 1.0%, the steel becomes hard and the workability is deteriorated. Thus, the Al content is to be in the range of 0.2% to 1.0%. The Al content is preferably in the range of 0.25% to 0.80% and more preferably in the range of 0.30% to 0.50%.

Aluminum is also an element that serves as a solid solution strengthening element when dissolved in the steel. Since Al contributes to increasing the high-temperature strength at a temperature exceeding 700° C., Al is an important element for the present disclosure. Moreover, Al exhibits a stronger solid solution strengthening effect when the strain rate is small, such as in a thermal fatigue test. As discussed earlier, if the Al content is greater than the Si content, Al preferentially forms oxides and nitrides at high temperature. As a result, the amount of dissolved Al is decreased, and Al does not contribute to solid solution strengthening as much. In contrast, if the Al content is equal to or less than the Si content, Si is preferentially oxidized and a dense oxide layer is continuously formed on a steel sheet surface. This oxide layer serves as a barrier for inward diffusion of oxygen and nitrogen and the solid solution state of Al can be stabilized. As a result, the high-temperature strength can be increased through solid solution strengthening due to Al.

N: 0.015% or Less

Nitrogen (N) is an element that deteriorates toughness and formability of steel. At a N content exceeding 0.015%, these adverse effects become notable. Thus, the N content is to be 0.015% or less. The N content is preferably as low as possible from the viewpoint of reliably obtaining toughness and formability, and is preferably less than 0.012%. As such, N is preferably not intentionally added. It takes, however, a long time to decrease the N content to less than 0.004%, thereby increasing the manufacturing cost. Thus, considering the balance between properties and cost, the N content is preferably 0.004% or more and less than 0.012%.

Cu: 1.0% to 2.0%

Copper (Cu) is a very effective element for improving the thermal fatigue resistance. For an Nb-containing steel, such as the steel of the present disclosure, to obtain a thermal fatigue resistance comparable or superior to that of SUS 444, the Cu content needs to be 1.0% or more. However, at a Cu content exceeding 2.0%, the steel becomes significantly hard, the room-temperature workability is significantly deteriorated, and embrittlement is likely to occur during hot working. More importantly, containing Cu improves the thermal fatigue resistance but deteriorates the oxidation resistance of the steel. In other words, containing Cu may deteriorate the heat resistance in an overall evaluation. The cause for deterioration of the heat resistance in an overall evaluation is probably attributable to concentration of Cu in the Cr depleted zone immediately below the generated scale and the resulting suppression of re-diffusion of Cr, which is an element that improves the oxidation resistance, intrinsic property of the stainless steel. Thus, the Cu content is to be in the range of 1.0% to 2.0%, preferably in the range of 1.0% to 1.8%, and more preferably in the range of 1.2% to 1.6%.

Nb: 0.30% to 0.65%

Niobium (Nb) fixes C and N by forming carbonitrides with C and N, has an effect of enhancing corrosion resistance, formability, and weld-zone intergranular corrosion resistance, and has an effect of improving the thermal fatigue resistance by increasing the high-temperature strength. Thus, Nb is an important element for the present disclosure. These effects are obtained at a Nb content of 0.30% or more. However, at a Nb content exceeding 0.65%, Laves phases ($Fe_2Nb$) are likely to be precipitated and embrittlement is promoted. Moreover, when the amount of dissolved Nb is decreased, the effect of improving high-temperature strength is no longer obtained. Thus, the Nb content is to be in the range of 0.30% to 0.65% and preferably in the range of 0.35% to 0.55%. Considering the balance between high-temperature strength and toughness, the Nb content is preferably in the range of 0.40% to 0.50% and more preferably in the range of 0.43% to 0.48%.

Ti: 0.50% or Less

Titanium (Ti), as with Nb, is an element that fixes C and N, improves corrosion resistance and formability, and prevents weld-zone intergranular corrosion. For Al-containing steels such as the steel of the present disclosure, Ti is a very effective element for improving the oxidation resistance. In particular, when the steel is to be used in a high-temperature range exceeding 1000° C., Ti is an effective additive element in order to obtain excellent oxidation resistance. In order to obtain such oxidation resistance at high temperature, the Ti content is preferably 0.005% or more. At a Ti content exceeding 0.50%, however, not only the oxidation resistance improving effect is saturated but also generation of coarse nitrides deteriorates toughness. Manufacturability is adversely affected; for example, fracture may occur when the steel is repeatedly bent and unbent in a hot-rolled-sheet annealing line. Moreover, coarse TiN are likely to serve as starting points for cracks in a high-temperature fatigue test and an excellent high-temperature fatigue resistance is not obtained. Thus, the upper limit of the Ti content is 0.50%.

Typical steels which have been used in exhaust parts of automobile engines, etc., may cause malfunction of engines due to spalling of scale generated on the parts surfaces when exposed to high temperature. Adding Ti is particularly effective for eliminating such spalling of scale. At a Ti content exceeding 0.15%, spalling of scale at a high temperature range of 1000° C. or higher can be significantly reduced. Thus, for steels that are used in applications where spalling of scale poses a problem, the Ti content is preferably controlled to more than 0.15% but not more than 0.5%.

The reason why the oxidation resistance of the Al-containing steel is improved by containing Ti is presumably that Ti added to the steel preferentially combines with N at high temperature, thereby suppressing precipitation of AlN formed by combining of Al and N. As a result, the amount of free Al (dissolved Al) in the steel increases, and oxygen (0) that has invaded into the steel without being blocked by the dense Si oxide layer formed on the steel sheet surface forms an Al oxide ($Al_2O_3$) at the interface between the base metal and the Si oxide layer, thereby suppressing oxidation of Fe and Cr caused by combining with O. Presumably, as a result, invasion of O into the interior of the steel sheet is blocked by the double structure constituted by the Si oxide layer and the Al oxide layer and the oxidation resistance is improved.

O (Oxygen): 0.0030% or Less

Oxygen (O) is an important element for Al-containing steels such as the steel of the present disclosure. Oxygen in the steel preferentially combines with Al in the steel when exposed to high temperature, and decreases the amount of the dissolved Al. When the amount of the dissolved Al is decreased, high-temperature strength is deteriorated. Moreover, coarse Al oxides precipitated in the steel serve as starting points of cracks in a high-temperature fatigue test and deteriorate the high-temperature fatigue resistance of the steel. When a lot of O is present in the steel, not only the oxygen combines with corresponding amounts of Al and thus the amount of dissolved Al is decreased but also the oxygen from outside can easily invade into the steel. Thus, when a lot of O is present in the steel, more Al oxides than predicated from the O content of the steel are easily formed. Therefore, the O content is preferably as low as possible and is limited to 0.0030% or less. The O content is preferably 0.0020% or less and more preferably 0.0015% or less.

Al/O≥100

As discussed above, reduction of the O content is important for Al-containing steels such as the steel of the present disclosure in order to improve the high-temperature fatigue resistance by utilizing the solid solution strengthening effect of Al. The inventors have thoroughly studied the effects of the Al/O≥content ratio on the high-temperature fatigue resistance and found that a steel exhibits a particularly excellent high-temperature fatigue resistance when Al: 0.2% to 1.0%, O: 0.0030% or less, and Al/O≥100. The reason for this is probably as follows. Aluminum (Al) oxides formed as a result of combining of Al with O present in the steel is not so dense as Al oxides formed as a result of combining of Al with O that has invaded into the steel from the surrounding environment upon exposure to high temperature, and thus rarely contribute to improving oxidation resistance but allow invasion of oxygen further from the surrounding environment and promote formation of Al oxides, which serve as starting points of cracks.

Basic Test

In the description below, "%" used to describe content of each component of the steel means "% by mass" The basic composition is C: 0.010%, Si: 0.8%, Mn: 0.2%, P: 0.030%, S: 0.002%, Cr: 17%, N: 0.010%, Cu: 1.3%, Nb: 0.5%, and Ti: 0.1%. The steels in which Al and O were added in various amounts ranging from 0.1% to 0.5% and 0.001% to 0.006% respectively to this basic composition was melted on a laboratory scale and casted into 30 kg steel ingots. Each ingot was heated to 1170° C. and hot-rolled into a sheet bar having a thickness of 35 mm and a width of 150 mm. The sheet bar was heated to 1050° C. and hot-rolled into a hot rolled sheet having a thickness of 5 mm. Subsequently, the hot rolled sheet was annealed at 900° C. to 1050° C. and pickled to prepare a hot rolled and annealed sheet, and the hot rolled and annealed sheet was cold-rolled to a thickness of 2 mm. The resulting cold rolled sheet was finish annealed at 850° C. to 1050° C. to obtain a cold-rolled and annealed sheet. The cold-rolled and annealed sheet was subjected to a high-temperature fatigue test described below.

High-Temperature Fatigue Test

A high-temperature fatigue test specimen having a shape shown in FIG. 1 was prepared from the cold-rolled and annealed sheet obtained as above, and subjected to a high-temperature fatigue test described below.

To a surface of the cold-rolled and annealed sheet, 70 MPa of bending stress was applied at 800° C. and 1300 rpm using a Schenck type fatigue tester. The number of cycles performed until fracture of the test specimen (number of cycles to fracture) was regarded as the high-temperature fatigue lifetime. Evaluation was based on the following criteria:

Circles (pass): No fracture for $100\times10^5$ cycles.

Triangles (fail): The number of cycles to fracture was $15\times10^5$ or more and less than $100\times10^5$.

Cross marks (fail): The number of cycles to fracture was less than $15\times10^5$.

Figure 4:
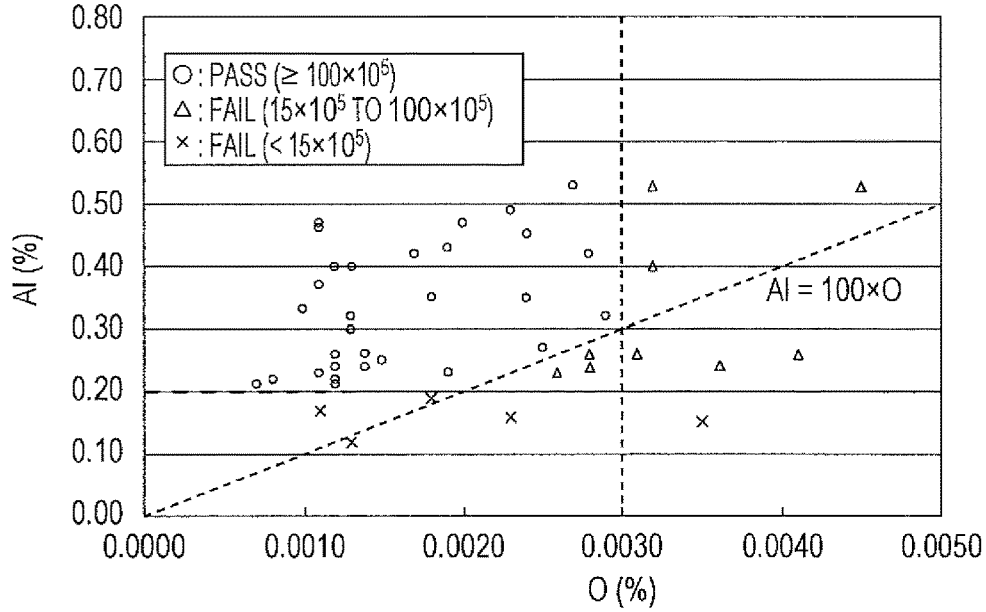
FIG. 4 is a diagram illustrating the effects of the Al content and the O content on the high-temperature fatigue resistance.

FIG. 4 shows the results of the high-temperature fatigue test. FIG. 4 demonstrates that a particularly excellent high-temperature fatigue lifetime is obtained when O content is 0.0030% or less, the Al content is 0.2% or more, and Al/O≥100. The "O (%)" in the horizontal axis indicates the O content and the "Al (%)" in the vertical axis indicates the Al content.

In addition to the above-mentioned essential components, the ferritic stainless steel according to the present disclosure may contain at least one element selected from B, REM, Zr, V, Co, Ni, Ca, Mg, and Mo in the ranges described below.

B: 0.0030% or Less

Boron (B) is an effective element for improving workability, in particular, secondary workability, of steel. Boron also has an effect of preventing Al from combining with N in the steel to form nitrides. These effects are obtained at a B content of 0.0003% or more. At a B content exceeding 0.0030%, excessive BN is generated and BN tends to be coarse; thus, the workability is deteriorated. If B is to be added, the B content is to be 0.0030% or less, preferably in the range of 0.0005% to 0.0020%, and more preferably in the range of 0.0008% to 0.0015%.

REM: 0.080% or Less, Zr: 0.50% or Less

A rare earth element (REM) and Zr are both an element that improves oxidation resistance. In order to obtain this effect, the REM content is preferably 0.005% or more, or the Zr content is preferably 0.005% or more. At a REM content exceeding 0.080%, the steel becomes brittle. At a Zr content exceeding 0.50%, Zr intermetallic compounds are precipitated and the steel becomes brittle. Thus, when REM and Zr are to be contained, the REM content and the Zr content are to be 0.080% or less and 0.50% or less, respectively.

V: 0.50% or Less

Vanadium (V) is an element effective for improving workability of the steel and improving oxidation resistance. These effects are notable when the V content is 0.01% or more. At a V content exceeding 0.50%, however, precipitation of coarse V(C, N) results and the surface property of the steel is deteriorated. Thus, if V is to be added, the V content is to be 0.50% or less. The V content is preferably in the range of 0.01% to 0.50%, more preferably in the range of 0.03% to 0.40%, and yet more preferably in the range of 0.05% to less than 0.20%.

Vanadium (V) is also an element effective for improving toughness of the steel. It is particularly effective from the viewpoint of improving toughness to add V to a Ti-containing steel which contains Ti in order to achieve oxidation resistance at 1000° C. or higher. This effect is achieved at a V content of 0.01% or more. At a V content exceeding 0.50%, toughness is deteriorated. Thus, a Ti-containing steel for use in applications that require toughness preferably has a V content in the range of 0.01% to 0.50%.

The toughness improving effect of V for the Ti-containing steel is presumably attributable to substitution of some of Ti by V in TiN precipitates in the steel. This is presumably because (Ti, V)N, which grows slower than TiN, is precipitated and thus precipitation of coarse nitrides that cause deterioration of toughness is suppressed.

Co: 0.50% or Less

Cobalt (Co) is an element effective for improving toughness of the steel. Cobalt also has an effect of decreasing the thermal expansion coefficient and improving the thermal fatigue resistance. In order to obtain these effects, the Co content is preferably 0.005% or more. However, Co is an expensive element and the effect is saturated beyond a Co content of 0.50%. Thus, if Co is to be added, the Co content is preferably 0.50% or less and is more preferably in the range of 0.01% to 0.20%. If a cold rolled sheet with excellent toughness is needed, the Co content is preferably 0.02% to 0.20%.

Ni: 0.50% or Less

Nickel (Ni) is an element that improves toughness of the steel. Nickel also has an effect of improving oxidation resistance of the steel. In order to obtain these effects, the Ni content is preferably 0.05% or more. Meanwhile, Ni is not only expensive but is also a strong γ-phase-forming element. Addition of Ni promotes formation of γ phases at high temperature. Once γ phases are generated, not only the oxidation resistance is deteriorated, but also the thermal expansion coefficient is increased causing deterioration of the thermal fatigue resistance. Thus, if Ni is to be contained, the Ni content is to be 0.50% or less. The Ni content is preferably in the range of 0.05% to 0.40% and more preferably 0.10% to 0.25%.

Ca: 0.0050% or Less

Calcium (Ca) is a component effective for preventing clogging of nozzles caused by precipitation of Ti-based inclusions that readily occur during continuous casting. The effect is obtained at a Ca content of 0.0005% or more. In order to obtain a satisfactory surface property without causing surface defects, the Ca content needs to be 0.0050% or less. Thus, if Ca is to be added, the Ca content is preferably in the range of 0.0005% to 0.0050%, more preferably in the range of 0.0005% or more and 0.0030% or less, and yet more preferably in the range of 0.0005% or more and 0.0015% or less.

Mg: 0.0050% or Less

Magnesium (Mg) is an element that increases the equiaxed crystal ratio of a slab and is effective for improving workability and toughness. Magnesium is also an element effective for suppressing coarsening of carbonitrides of Nb and Ti. Once Ti carbonitrides become coarse, they serve as starting points of brittle cracking and toughness is deteriorated. Once Nb carbonitrides become coarse, the amount of dissolved Nb in the steel is decreased and thereby the thermal fatigue resistance is deteriorated. These effects are obtained at a Mg content of 0.0010% or more. However, at a Mg content exceeding 0.0050%, the surface property of the steel is deteriorated. Thus, if Mg is to be added, the Mg content is preferably in the range of 0.0010% or more and 0.0050% or less and is more preferably in the range of 0.0010% or more and 0.0020% or less.

Mo: 0.1% to 1.0% or Less

Molybdenum (Mo) is an element that can improve the heat resistance by increasing the high-temperature strength. Since Mo is an expensive element, use of Mo tends to be avoided. If an excellent heat resistance is needed irrespective of the cost, Mo may be contained in an amount of 0.1% to 1.0%.

The balance of the essential elements and optional elements described above is Fe and unavoidable impurities.

Next, a method for producing a ferritic stainless steel according to the present disclosure is described.

The method for producing a stainless steel according to the present disclosure is not particularly limited, and may be any common method for producing a ferritic stainless steel basically. However, in order to decrease the O content of the steel, which is critical to the present disclosure, production conditions are controlled in the refining step as described below. An example of the production method is as follows. First, a molten steel is produced in a known melting furnace, such as a converter or an electric furnace, and optionally further subjected to secondary refining such as ladle refining or vacuum refining, to prepare a steel having the composition of the present disclosure described above. During this process, the content of 0, which is an important element in the present disclosure, needs to be sufficiently decreased. Merely adding Al may not sufficiently decrease the O content of the steel. For example, if the basicity ($CaO/Al_2O_3$) of the slag generated is low, the equilibrium oxygen concentration is increased and the O content of the steel is increased. When the steel after vacuum refining is exposed to air for a long time, oxygen from the air may invade into the steel. Thus, in producing the steel developed, the basicity of the slag is controlled to be high, and the time for which the molten steel after vacuum refining is held open to air is shortened as much as possible. Then the steel is formed into a slab by a continuous casting method or an ingoting-slabbing method. Then steps such as hot rolling, hot-rolled-sheet annealing, pickling, cold rolling, finish annealing, and pickling are performed to form a cold rolled and annealed sheet. The cold rolling may be performed once, or two or more times with intermediate annealing performed in between. The steps of cold rolling, finish annealing, and pickling may be repeated. The hot-rolled-sheet annealing may be omitted. If the steel is required to have a glossy surface or roughness adjusted, skin-pass rolling may be performed on the cold rolled sheet after cold rolling or the annealed sheet after finish annealing.

Preferable production conditions in the production method described above will now be described.

In the steelmaking step of producing molten steel, a molten steel prepared in a converter or an electric furnace is preferably subjected to secondary refining by a VOD method or the like to prepare a steel that contains the essential components and optional components described above. The molten steel prepared can be formed into a steel material (slab) by a known method. From the viewpoints of productivity and quality, a continuous casting method is preferably employed. The steel material is then heated to 1000° C. to 1250° C. and hot-rolled into a hot-rolled sheet having a desired thickness. Naturally, the steel material may be hot-worked into a shape other than the sheet. The obtained hot rolled sheet is then continuously annealed at 900° C. to 1100° C. and pickled to remove the scale, thereby offering a hot-rolled product. In the present disclosure, this annealing is optional, and if no annealing is performed, the hot rolled sheet obtained by hot rolling is used as the hot rolled product. The cooling rate after annealing is not particularly limited but cooling is preferably performed as quickly as possible. If needed, scale may be removed by shot blasting prior to pickling.

The hot rolled and annealed sheet or the hot rolled sheet may be prepared into a cold rolled product by performing such a step as cold rolling. Cold rolling may be performed once or two or more times with intermediate annealing in between from the viewpoints of productivity and required quality. The total reduction in the cold rolling step that includes performing cold rolling once or more than once is 60% or more and preferably 70% or more. The cold rolled steel sheet is then preferably subjected to continuous annealing (finish annealing) at a temperature of 900° C. to 1150° C. and preferably at a temperature of 950° C. to 1120° C. and pickled to prepare a cold rolled product. The cooling rate after annealing is not particularly limited but is preferably as high as possible. Depending on the usage, skin-pass rolling or the like may be performed after finish annealing so as to adjust the shape, surface roughness, and material property of the steel sheet.

The hot rolled product or the cold-rolled and annealed product prepared as described above is subjected to cutting, bending, bulging, and/or drawing, for example, depending on the usage so as to form exhaust pipes and catalyst cases of automobiles and motorcycles, exhaust ducts of thermal power plants, and parts, for example, separators, interconnectors, and reformers, of fuel cells. The welding method for these parts is not particularly limited. Examples of the method include common arc welding methods such as metal inert gas (MIG), metal active gas (MAG), and tungsten inert gas (TIG) welding methods, resistance welding methods such as spot welding and seam welding, and high-frequency resistance welding and high-frequency inductive welding such as an electric welding method.

Examples

Steels having compositions shown in Table 1 (tables 1-1, 1-2, and 1-3 are collectively referred to as Table 1) were each prepared by a vacuum melting furnace and cast to form a 50 kg steel ingot. The steel ingot was forged and halved. One of the halves was heated to 1170° C. and hot-rolled into a hot rolled sheet having a thickness of 5 mm. The hot-rolled sheet was annealed at a temperature determined for each steel by checking the microstructure in the range of 1000° C. to 1100° C., and pickled. The pickled steel sheet was cold-rolled at a reduction of 60%, and the resulting cold rolled sheet was finish-annealed at a temperature in the range of 1000° C. to 1100° C. determined for each steel by checking the microstructure, and pickled to prepare a cold-rolled and annealed sheet having a thickness of 2 mm. This cold-rolled and annealed sheet was used in a high-temperature fatigue test described below.

<High-Temperature Fatigue Test>

A fatigue test specimen having a shape shown in FIG. 1 was prepared from the cold-rolled and annealed sheet obtained as described above and subjected to a high-temperature plane bending fatigue test. The testing temperature was 850° C. and the frequency was 22 Hz (=1,300 rpm). Reversed bending was repeated so that the plane stress was 75 MPa and the number of cycles to cracking was regarded as the lifetime. Evaluation was based on the following criteria:

Circles (pass): No fracture for $100\times10^5$ cycles.

Triangles (fail): The number of cycles to fracture was $15\times10^5$ or more and less than $100\times10^5$.

Cross marks (fail): The number of cycles to fracture was less than $15\times10^5$.

The results are summarized in Table 1.

<Continuous Oxidation Test in Air>

A 30 mm×20 mm sample was cut out from each of the cold-rolled and annealed sheets obtained as described above. A hole 4 mm in diameter was formed in an upper portion of the sample. Surfaces and end surfaces were polished with a #320 emery paper, and the sample was degreased. The degreased sample was suspended in an air atmosphere in a furnace heated and held at 950° C. and was left suspended for 300 hours. After the test, the mass of the sample was measured and the difference from the mass before the test measured in advance was determined to calculate the weight gain ($g/m^2$) by oxidation. The test was conducted twice and samples whose average weight gain by oxidation was 27 $g/m^2$ or less were rated pass (indicated by circles), and samples whose average weight gain by oxidation was more than 27 $g/m^2$ were rated fail (indicated by cross marks) in evaluating the oxidation resistance.

<Thermal Fatigue Test>

Figure 2:
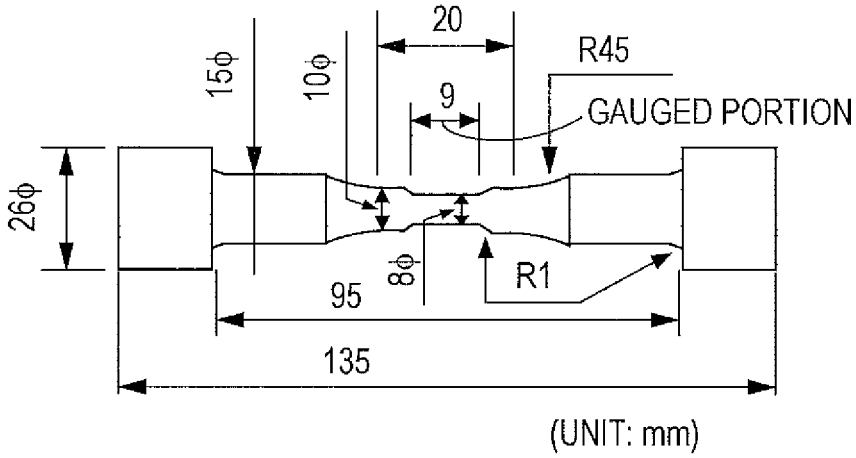
FIG. 2 A diagram illustrating a thermal fatigue test specimen.

The other half of the 50 kg steel ingot was heated to 1170° C. and hot-rolled into a sheet bar having a thickness of 30 mm and a width of 150 mm. The sheet bar was forged into a 35 mm square bar and annealed at a temperature of 1030° C. The annealed bar was machined to prepare a thermal fatigue test specimen having a shape and dimensions shown in FIG. 2. The thermal fatigue test specimen was used in the thermal fatigue test described below.

Figure 3:
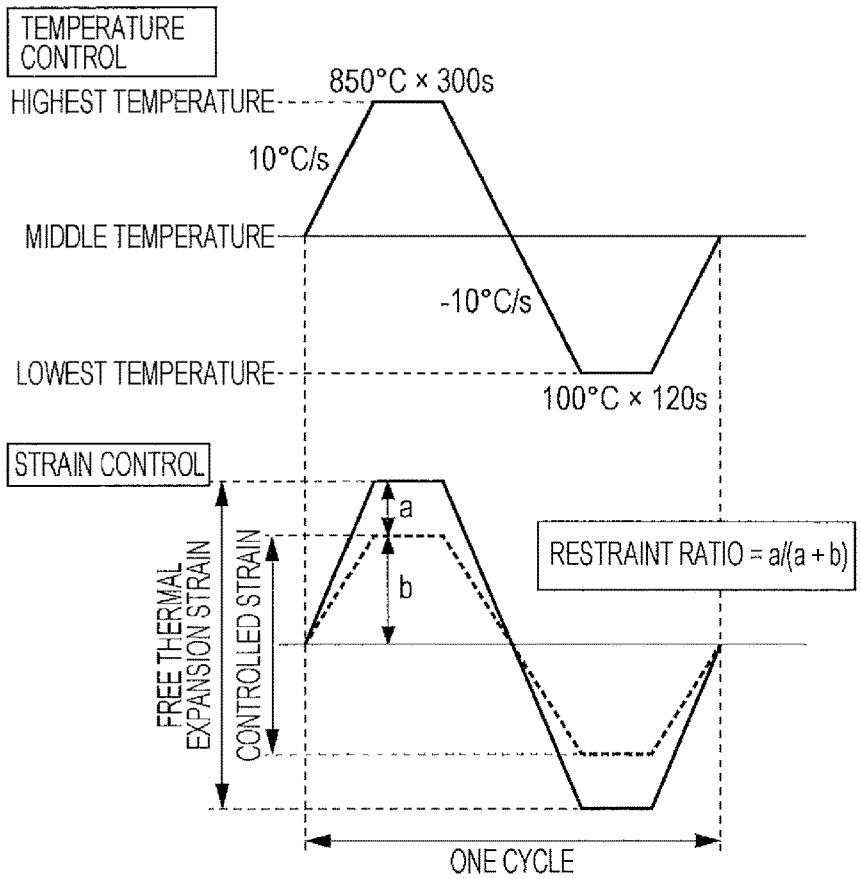
FIG. 3 A diagram illustrating thermal fatigue test conditions (temperature and restraint conditions).

As indicated in FIG. 3, the thermal fatigue test was conducted by repeating heating and cooling between 100° C. and 850° C. while restraining the test specimen at a restraint ratio of 0.35. During this process, the heating rate and the cooling rate were 10° C./sec each, the holding time at 100° C. was 2 min, and the holding time at 850° C. was 5 min. The thermal fatigue lifetime was determined by dividing the load detected at 100° C. by the cross-sectional area of the gauged portion of the specimen (refer to FIG. 2) to calculate stress and determining the number of cycles taken for the stress to decrease to 75% of the stress at the initial stage of the test (fifth cycle). The thermal fatigue resistance was rated pass (indicated by circles) when the thermal fatigue lifetime was 1120 cycles or more and was rated fail (indicated by cross marks) when the thermal fatigue lifetime was less than 1120 cycles.

TABLE 1

| No. | C | Si | Mn | P | S | Al | Ni | Cr | Nb | Ti | Cu |
|---|---|---|---|---|---|---|---|---|---|---|---|
| | | | | | | | | | | | % by mass |
| 1 | 0.008 | 0.43 | 0.10 | 0.029 | 0.002 | 0.30 | 0.07 | 21.1 | 0.35 | 0.02 | 1.29 |
| 2 | 0.004 | 0.83 | 0.36 | 0.038 | 0.002 | 0.22 | 0.14 | 12.1 | 0.37 | 0.25 | 1.35 |
| 3 | 0.004 | 0.98 | 0.20 | 0.038 | 0.003 | 0.26 | 0.21 | 18.1 | 0.56 | 0.16 | 1.42 |
| 4 | 0.004 | 0.25 | 0.41 | 0.028 | 0.003 | 0.21 | 0.18 | 13.1 | 0.47 | 0.11 | 1.28 |
| 5 | 0.005 | 0.78 | 0.83 | 0.023 | 0.001 | 0.37 | 0.23 | 20.9 | 0.60 | 0.22 | 1.49 |
| 6 | 0.009 | 0.95 | 0.16 | 0.028 | 0.002 | 0.89 | 0.22 | 15.3 | 0.39 | 0.48 | 1.22 |
| 7 | 0.009 | 0.77 | 0.09 | 0.034 | 0.001 | 0.32 | 0.47 | 17.3 | 0.59 | 0.21 | 1.41 |
| 8 | 0.006 | 0.74 | 0.28 | 0.031 | 0.001 | 0.21 | — | 15.3 | 0.39 | 0.12 | 1.06 |
| 9 | 0.003 | 0.62 | 0.33 | 0.023 | 0.002 | 0.43 | 0.30 | 20.5 | 0.41 | 0.43 | 1.95 |
| 10 | 0.010 | 0.65 | 0.19 | 0.029 | 0.002 | 0.47 | 0.16 | 19.9 | 0.56 | 0.24 | 1.78 |
| 11 | 0.005 | 0.83 | 0.16 | 0.032 | 0.002 | 0.33 | 0.14 | 16.9 | 0.47 | 0.01 | 1.27 |
| 12 | 0.003 | 0.76 | 0.32 | 0.030 | 0.002 | 0.35 | 0.21 | 13.8 | 0.36 | 0.27 | 1.48 |
| 13 | 0.007 | 0.70 | 0.40 | 0.039 | 0.001 | 0.47 | 0.28 | 13.2 | 0.31 | 0.07 | 1.24 |
| 14 | 0.009 | 0.52 | 0.30 | 0.022 | 0.001 | 0.42 | 0.12 | 15.4 | 0.48 | 0.20 | 1.31 |
| 15 | 0.009 | 0.96 | 0.35 | 0.036 | 0.001 | 0.46 | 0.14 | 17.8 | 0.53 | 0.02 | 1.39 |
| 16 | 0.010 | 0.79 | 0.14 | 0.026 | 0.003 | 0.26 | 0.18 | 12.0 | 0.54 | 0.10 | 1.36 |
| 17 | 0.007 | 0.93 | 0.11 | 0.033 | 0.002 | 0.25 | 0.20 | 12.4 | 0.51 | 0.08 | 1.23 |
| 18 | 0.007 | 0.89 | 0.26 | 0.027 | 0.001 | 0.22 | 0.16 | 16.4 | 0.41 | 0.09 | 1.48 |
| 19 | 0.009 | 0.65 | 0.41 | 0.036 | 0.002 | 0.23 | 0.27 | 18.8 | 0.48 | 0.10 | 1.38 |
| 20 | 0.004 | 0.87 | 0.43 | 0.023 | 0.001 | 0.24 | 0.22 | 17.0 | 0.45 | 0.22 | 1.25 |
| 21 | 0.005 | 0.78 | 0.35 | 0.026 | 0.002 | 0.40 | 0.16 | 12.5 | 0.48 | 0.03 | 1.44 |
| 22 | 0.007 | 0.94 | 0.17 | 0.027 | 0.002 | 0.24 | 0.26 | 19.4 | 0.38 | 0.06 | 1.21 |
| 23 | 0.003 | 0.72 | 0.23 | 0.031 | 0.002 | 0.49 | 0.05 | 18.6 | 0.49 | 0.26 | 1.31 |
| 24 | 0.004 | 0.97 | 0.27 | 0.025 | 0.002 | 0.40 | 0.23 | 20.8 | 0.53 | 0.11 | 1.48 |

| No. | N | Mo | V | Zr | Co | B | Ca | Mg | REM | O |
|---|---|---|---|---|---|---|---|---|---|---|
| | | | | | | | | | | % by mass |
| 1 | 0.008 | | | | | | | | | 0.0013 |
| 2 | 0.010 | | | | | | | | | 0.0008 |
| 3 | 0.010 | | | | | | | | | 0.0014 |
| 4 | 0.007 | | | | | | | | | 0.0007 |
| 5 | 0.005 | | | | | | | | | 0.0011 |
| 6 | 0.010 | | | | | | | | | 0.0019 |
| 7 | 0.011 | | | | | | | | | 0.0013 |
| 8 | 0.010 | | | | | | | | | 0.0012 |
| 9 | 0.009 | | | | | | | | | 0.0019 |
| 10 | 0.006 | | | | | | | | | 0.0011 |
| 11 | 0.008 | | | | | | | | | 0.0010 |
| 12 | 0.008 | 0.11 | | | | | | | | 0.0018 |
| 13 | 0.005 | 0.36 | | | | | | | | 0.0020 |
| 14 | 0.011 | | 0.05 | | | | | | | 0.0017 |
| 15 | 0.010 | | 0.20 | | | | | | | 0.0011 |
| 16 | 0.009 | | | 0.04 | | | | | | 0.0012 |
| 17 | 0.009 | | | | 0.03 | | | | | 0.0015 |
| 18 | 0.009 | | | | 0.22 | | | | | 0.0012 |
| 19 | 0.008 | | | | | 0.0003 | | | | 0.0011 |
| 20 | 0.010 | | | | | 0.0014 | | | | 0.0014 |
| 21 | 0.005 | | | | | | 0.0004 | | | 0.0013 |
| 22 | 0.010 | | | | | | | 0.0010 | | 0.0012 |
| 23 | 0.008 | | | | | | | | 0.02 | 0.0023 |
| 24 | 0.010 | | 0.06 | | 0.04 | 0.0005 | 0.0007 | 0.0009 | | 0.0012 |

| No. | C | Si | Mn | P | S | Al | Ni | Cr | Nb | Ti | Cu | N | O |
|---|---|---|---|---|---|---|---|---|---|---|---|---|---|
| | | | | | | | | | | | | | % by mass |
| 25 | 0.007 | 0.57 | 0.39 | 0.028 | 0.001 | 0.26 | 0.04 | 16.0 | 0.61 | 0.14 | 1.42 | 0.007 | 0.0028 |
| 26 | 0.010 | 0.86 | 0.35 | 0.035 | 0.001 | 0.24 | 0.08 | 20.1 | 0.25 | 0.16 | 1.14 | 0.010 | 0.0014 |
| 27 | 0.004 | 0.98 | 0.22 | 0.026 | 0.003 | 0.12 | 0.28 | 18.0 | 0.41 | 0.25 | 1.43 | 0.010 | 0.0013 |
| 28 | 0.004 | 0.96 | 0.20 | 0.040 | 0.003 | 0.23 | 0.16 | 13.2 | 0.55 | 0.14 | 1.78 | 0.006 | 0.0026 |
| 29 | 0.005 | 0.90 | 0.15 | 0.032 | 0.002 | 0.24 | 0.28 | 18.6 | 0.63 | 0.16 | 1.05 | 0.006 | 0.0057 |
| 30 | 0.008 | 0.76 | 0.24 | 0.039 | 0.002 | 0.24 | 0.19 | 19.3 | 0.48 | 0.24 | 1.22 | 0.009 | 0.0036 |
| 31 | 0.010 | 0.33 | 0.17 | 0.036 | 0.002 | 0.56 | 0.08 | 17.3 | 0.56 | 0.12 | 1.19 | 0.009 | 0.0010 |
| 32 | 0.006 | 0.49 | 0.23 | 0.030 | 0.002 | 0.24 | 0.11 | 16.5 | 0.44 | 0.20 | 1.46 | 0.011 | 0.0028 |
| 33 | 0.007 | 0.68 | 1.08 | 0.028 | 0.002 | 0.43 | 0.06 | 17.9 | 0.43 | 0.05 | 1.44 | 0.011 | 0.0014 |
| 34 | 0.006 | 0.47 | 0.26 | 0.030 | 0.002 | 0.29 | 0.13 | 9.4 | 0.48 | 0.23 | 1.62 | 0.011 | 0.0019 |
| 35 | 0.008 | 0.89 | 0.18 | 0.024 | 0.002 | 0.50 | 0.24 | 15.8 | 0.39 | 0.11 | 0.92 | 0.009 | 0.0015 |
| 36 | 0.007 | 0.37 | 0.24 | 0.033 | 0.002 | 0.31 | 0.20 | 17.2 | 0.42 | 0.54 | 1.50 | 0.010 | 0.0018 |
| 37 | 0.010 | 0.84 | 0.45 | 0.023 | 0.002 | 0.68 | 0.18 | 17.0 | 0.46 | 0.01 | 1.24 | 0.005 | 0.0038 |

| No. | Si—Al | Al/O | Thermal fatigue 850° C. | Continuous oxidation 950° C. | High-temperature fatigue 850° C. | Note |
|---|---|---|---|---|---|---|
| 1 | 0.13 | 231 | ○ | ○ | ○ | Example |
| 2 | 0.61 | 275 | ○ | ○ | ○ | Example |
| 3 | 0.72 | 186 | ○ | ○ | ○ | Example |

TABLE 1-continued

| | | | | | | |
|---|---|---|---|---|---|---|
| 4 | 0.04 | 300 | ○ | ○ | ○ | Example |
| 5 | 0.41 | 336 | ○ | ○ | ○ | Example |
| 6 | 0.06 | 468 | ○ | ○ | ○ | Example |
| 7 | 0.45 | 246 | ○ | ○ | ○ | Example |
| 8 | 0.53 | 175 | ○ | ○ | ○ | Example |
| 9 | 0.19 | 226 | ○ | ○ | ○ | Example |
| 10 | 0.18 | 427 | ○ | ○ | ○ | Example |
| 11 | 0.50 | 330 | ○ | ○ | ○ | Example |
| 12 | 0.41 | 194 | ○ | ○ | ○ | Example |
| 13 | 0.23 | 235 | ○ | ○ | ○ | Example |
| 14 | 0.10 | 247 | ○ | ○ | ○ | Example |
| 15 | 0.50 | 418 | ○ | ○ | ○ | Example |
| 16 | 0.53 | 217 | ○ | ○ | ○ | Example |
| 17 | 0.68 | 167 | ○ | ○ | ○ | Example |
| 18 | 0.67 | 183 | ○ | ○ | ○ | Example |
| 19 | 0.42 | 209 | ○ | ○ | ○ | Example |
| 20 | 0.63 | 171 | ○ | ○ | ○ | Example |
| 21 | 0.38 | 308 | ○ | ○ | ○ | Example |
| 22 | 0.70 | 200 | ○ | ○ | ○ | Example |
| 23 | 0.23 | 213 | ○ | ○ | ○ | Example |
| 24 | 0.57 | 333 | ○ | ○ | ○ | Example |
| 25 | 0.31 | 93 | ○ | ○ | Δ | Comparative Example |
| 26 | 0.62 | 171 | x | ○ | x | Comparative Example |
| 27 | 0.86 | 92 | ○ | x | x | Comparative Example |
| 28 | 0.73 | 88 | ○ | ○ | Δ | Comparative Example |
| 29 | 0.66 | 42 | ○ | ○ | Δ | Comparative Example |
| 30 | 0.52 | 67 | ○ | ○ | Δ | Comparative Example |
| 31 | −0.23 | 560 | ○ | ○ | x | Comparative Example |
| 32 | 0.25 | 86 | ○ | ○ | Δ | Comparative Example |
| 33 | 0.25 | 307 | x | x | Δ | Comparative Example |
| 34 | 0.18 | 153 | x | x | x | Comparative Example |
| 35 | 0.39 | 333 | x | ○ | ○ | Comparative Example |
| 36 | 0.06 | 172 | ○ | ○ | x | Comparative Example |
| 37 | 0.16 | 151 | ○ | ○ | x | Comparative Example |

Note:
Underlined items are outside the scope of the present disclosure.

The results of the high-temperature fatigue test, the continuous oxidation test in air, and the thermal fatigue test observed from the examples described above are summarized in Table 1. Table 1 shows that the steels according to the present disclosure satisfying the composition of the present disclosure have a particularly excellent high-temperature fatigue resistance in addition to an excellent thermal fatigue resistance and excellent oxidation resistance, and achieve the object of the present disclosure. In contrast, none of steels of comparative examples outside the range of the present disclosure have a particularly excellent high-temperature fatigue resistance, and none achieve the object of the present disclosure.

INDUSTRIAL APPLICABILITY

The ferritic stainless steel according to the present disclosure is suitable not only for use in high-temperature exhaust parts of automobiles and the like but also for use in exhaust parts of thermal power plants and solid oxide-type fuel cell parts that require similar properties.

The invention claimed is:

1. A ferritic stainless steel having a composition comprising:

C: 0.015% or less, by mass %;
Si: 1.0% or less, by mass %;
Mn: 1.0% or less, by mass %;
P: 0.040% or less, by mass %;
S: 0.010% or less, by mass %;
Cr: 10.0% to 23.0%, by mass %;
Al: 0.2% to 1.0%, by mass %;
N: 0.015% or less, by mass %;
Cu: 1.0% to 2.0%, by mass %;
Nb: 0.30% to 0.65%, by mass %;
Ti: 0.50% or less, by mass %; and
O: 0.0030% or less, by mass %;
the balance being Fe and unavoidable impurities, wherein:
a Si content and an Al content satisfy Si≥Al, and
the Al content and an O content satisfy Al/O≥100.

2. The ferritic stainless steel according to claim 1, wherein the composition further comprises at least one element selected from the group consisting of:

B: 0.0030% or less, by mass %;
REM: 0.080% or less, by mass %;
Zr: 0.50% or less, by mass %;
V: 0.50% or less, by mass %;
Co: 0.50% or less, by mass %; and
Ni: 0.50% or less, by mass %.

3. The ferritic stainless steel according to claim 1, wherein the composition further comprises at least one element selected from the group consisting of:

Ca: 0.0050% or less, by mass %; and
Mg: 0.0050% or less, by mass %.

4. The ferritic stainless steel according to claim 2, wherein the composition further comprises at least one element selected from the group consisting of:

Ca: 0.0050% or less, by mass %; and
Mg: 0.0050% or less, by mass %.

5. The ferritic stainless steel according to claim 1, wherein the composition further comprises Mo: 0.1% to 1.0%, by mass %.

6. The ferritic stainless steel according to claim 2, wherein the composition further comprises Mo: 0.1% to 1.0%, by mass %.

7. The ferritic stainless steel according to claim 3, wherein the composition further comprises Mo: 0.1% to 1.0%, by mass %.

8. The ferritic stainless steel according to claim 4, wherein the composition further comprises Mo: 0.1% to 1.0%, by mass %.

* * * * *